US006731052B2

(12) United States Patent
Moriya

(10) Patent No.: US 6,731,052 B2
(45) Date of Patent: May 4, 2004

(54) SPARK PLUG HAVING GROUND ELECTRODE HAVING CROSS SECTION WITH SIDE SURFACE OPPOSITE CENTER ELECTRODE OF SMALLER WIDTH THAN OPPOSING SIDE SURFACE

(75) Inventor: Tooru Moriya, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 295 days.

(21) Appl. No.: 09/739,306

(22) Filed: Dec. 19, 2000

(65) Prior Publication Data

US 2001/0004183 A1 Jun. 21, 2001

(30) Foreign Application Priority Data

Dec. 20, 1999 (JP) ..... 11-360295

(51) Int. Cl.[7] ..... H01T 13/20
(52) U.S. Cl. ..... 313/141
(58) Field of Search ..... 313/140, 141, 313/142, 144; 123/169 EL

(56) References Cited

U.S. PATENT DOCUMENTS 4,401,915 A * 8/1983 Kashiwara et al. ..... 313/142
4,465,952 A 8/1984 Sato et al. ..... 313/136
4,970,426 A * 11/1990 Bronchart ..... 313/141
5,828,161 A * 10/1998 Palyu ..... 313/141
6,166,480 A * 12/2000 Ishida et al. ..... 313/141

FOREIGN PATENT DOCUMENTS

| | | |
|---|---|---|
| EP | 0 725 463 A1 | 8/1996 |
| JP | 59-36390 | 9/1984 |
| JP | 8-213149 | 8/1996 |
| JP | 9-129356 | 5/1997 |

* cited by examiner

*Primary Examiner*—Jay Patidar
(74) *Attorney, Agent, or Firm*—Sughrue Mion, PLLC

(57) ABSTRACT

In a spark plug for an internal combustion engine, a welded portion of a ground electrode has a polygonal cross section including six corners. A side surface of the ground electrode, positioned opposite to a side surface including a surface portion opposite to a front end face of a center electrode, is smaller in width than the opposite side surface so that the ground electrode can be larger in width and thickness than a spark plug of a related art without causing the corners of the cross section of the ground electrode at the joint between the ground electrode and a metallic shell to protrude from a front end face of a metallic shell.

8 Claims, 11 Drawing Sheets

FIG.6

SIDEWAY JUMPING
OCCURRENCE TEST RESULT

| | | METALLIC SHELL INNER DIAMETER B | INSULATOR FRONT END PORTION DIAMETER C | CLEARANCE D | SIDEWAY JUMPING OCCURRENCE VOLTAGE (BY COMPARISON WITH RELATED ART) |
|---|---|---|---|---|---|
| RELATED ART | t1=1.3<br>L1=2.7 | 7.20 | 4.30 | 1.45 | AS USUAL |
| UNMODIFIED | t2=1.4<br>L2=2.9 | 6.94 | 4.30 | 1.32 | −1.3kV |
| INVENTION | t4=1.4<br>L6=2.9<br>L5=1.4 | 7.20 | 4.30 | 1.45 | ±0.0kV |

SPARK PLUG HAVING GROUND ELECTRODE HAVING CROSS SECTION WITH SIDE SURFACE OPPOSITE CENTER ELECTRODE OF SMALLER WIDTH THAN OPPOSING SIDE SURFACE

BACKGROUND OF THE INVENTION

The present invention relates to a spark plug for internal combustion engines.

SUMMARY OF THE INVENTION

In recent years, there is an increasing demand for a highly durable spark plug for internal combustion engines as the engines become higher in efficiency. Under these circumstances, the durability of the ground electrode is one of the most important problems to be solved. There are two problems with respect to the durability required for the ground electrode. One problem is concerned with the resistance to electrode consumption due to spark discharge. Another problem is concerned with the strength. Namely, there is a problem that transmission of engine vibrations to the ground electrode may possibly cause a crack at the welded portion between the ground electrode and the metallic shell and the progress of the crack may cause the ground electrode to be broken.

With reference to FIGS. 10A–10C and 11A–11C, the structure of the ground electrode will be described.

As shown in FIG. 1A, a welded portion 16*c* of a ground electrode 16 connected to a front end face 37 of a metallic shell 30 is generally rectangular in cross section and has the maximum width L1 and the maximum thickness t1. As shown in FIG. 10B, assuming that M denotes the nominal diameter of an externally threaded portion 31 of the metallic shell 30, A denotes the outer diameter of the front end face 37 and B denotes the inner diameter of the front end face 37, a spark plug of 12.00 mm in the nominal diameter M of the externally threaded portion 31 is, for example, 10.10 mm in the outer diameter A of the front end face 37. In this instance, if the inner diameter B is 7.20 mm, the welded portion 16*c* can be sized to be 1.30 mm in the maximum thickness t1 and 2.70 mm in the maximum width L1. In the meantime, as shown in FIG. 10B, a clearance 24*a* is provided between the inner circumferential surface of the metallic shell 30 and the outer circumferential surface of an insulator front end portion 24.

Herein, as a means for improving the resistance to consumption of the ground electrode 16, it is considered to expand the maximum width L1 of the ground electrode 16 and thereby make larger the area of a side surface portion 16*g* facing the center electrode 12. Further, as a means for making the strength of the ground electrode 16 higher, it is considered to make the maximum thickness t1 thicker and thereby make the rigidity of the ground electrode 16 higher.

However, if the maximum width L1 of the ground electrode 16 is made wider and the maximum thickness t1 is made thicker, the side surface 16*a* including the side surface portion 16*g* facing the center electrode 12 protrudes from the inner circumferential periphery 37*b* of the front end face 37, and the opposite end corner portions 16*e* of the side surface 16*b* opposite to the side surface 16*a* protrude from the outer circumferential periphery 37*a* of the front end face 37 as shown in FIG. 11B. To eliminate such protrusion, it is necessary to make the metallic shell 30 thicker and thereby make the area of the front end face 37 larger. In this connection, the width of the front end face 37 can be made larger by making the outer diameter A of the end face 37 large or the inner diameter B smaller. However, increase of the outer diameter A inevitably results in increase of the nominal diameter M of the externally threaded portion 31 of the metallic shell 30. This disables attachment of the spark plug to the cylinder head, so the outer diameter A cannot be made larger.

If the inner diameter B is reduced, as shown in FIG. 11C, from the position indicated by 37*b* to the position indicated by 37*c*, the clearance 24*a* between the inner circumferential surface of the metallic shell 37 and the insulator front end portion 24 will inevitably reduce. By this, sideway jumping of spark due to adherence of carbon onto the surface of the insulator front end portion 24 is liable to be caused, thus causing a problem that the ignition ability is lowered.

It is accordingly an object of the present invention to provide a spark plug for internal combustion engines which can improve the resistance to electrode consumption and the strength of the ground electrode without changing the inner and outer diameters of the end face of the metallic shell.

To accomplish the above object, the present invention provides a spark plug for an internal combustion engine comprising a metallic shell having an externally threaded portion, an insulator disposed in the metallic shell and having an axial bore, a center electrode disposed in the axial bore of the insulator, and a ground electrode connected to a front end face of the metallic shell and having an end opposite to an front end face of the center electrode, wherein a cross section of the ground electrode is so shaped as to provide a side surface at one of opposite sides which faces an outer circumferential periphery of the front end face of the metallic shell, with a narrower central side surface section than that of a side surface at the other of the opposite sides, the central side surface section at one of the opposite sides being parallely opposite to the central side surface section at the other of the opposite sides.

BRIEF DESCRIPTION OF THE DRAWINGS

FIG. 6 is a graph showing a sideway jumping occurrence test result by experiment 3;

DESCRIPTION OF THE PREFERRED EMBODIMENTS

Figure 1:
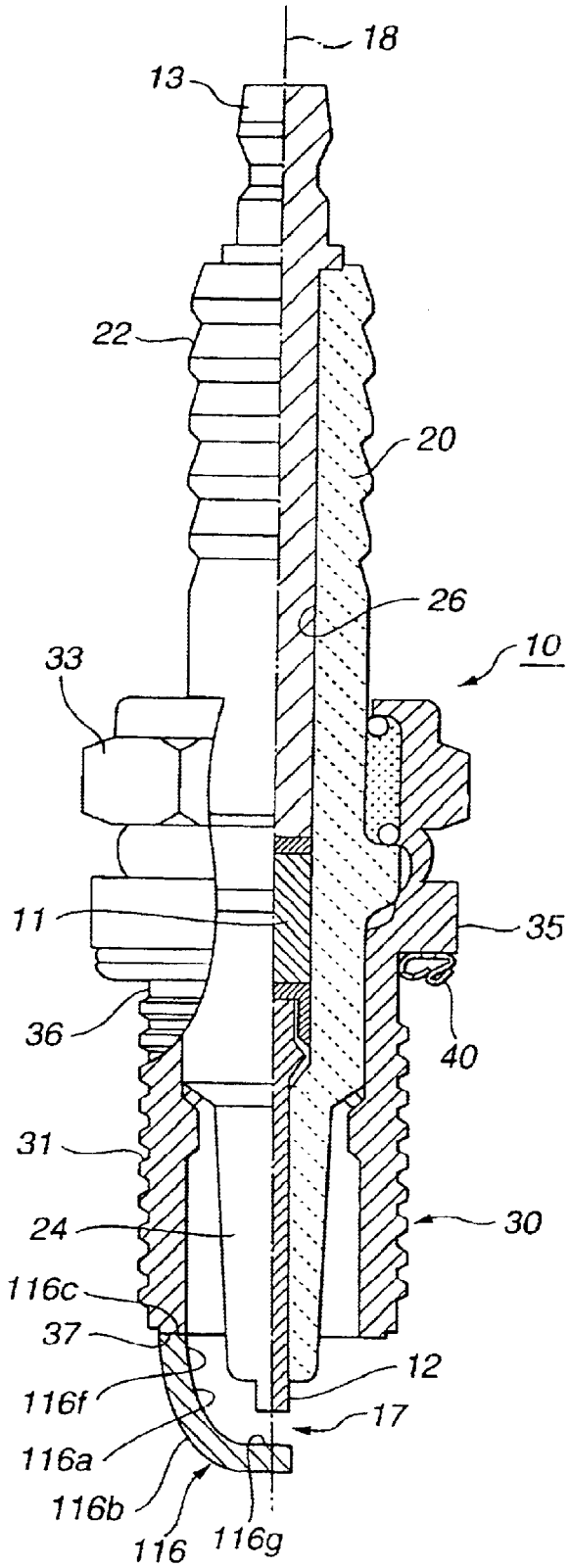
FIG. 1 is a partly sectional side elevation of a spark plug according to an embodiment of the present invention.
Figure 2A:
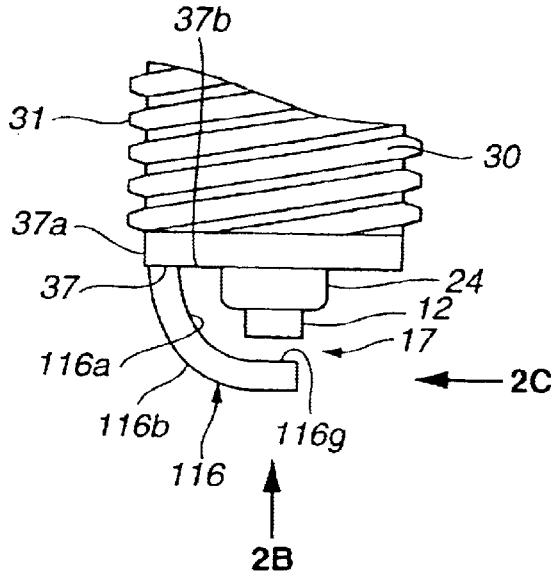
FIG. 2A is an enlarged fragmentary side elevation of the spark plug of FIG. 1.
Figure 2B:
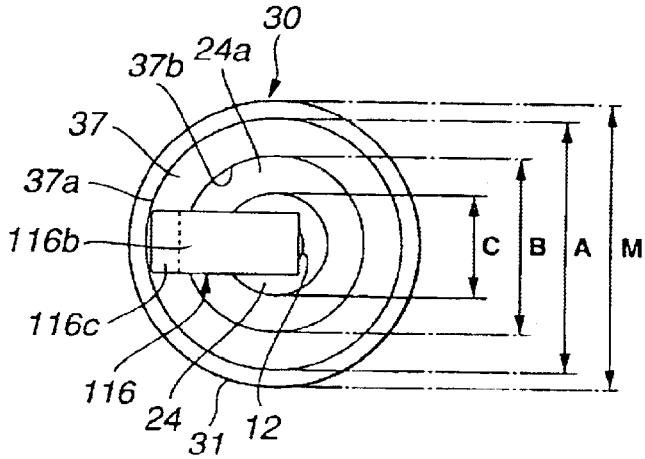
FIG. 2B is a view taken in the direction indicated by the arrow 2B in FIG. 2A.
Figure 2C:
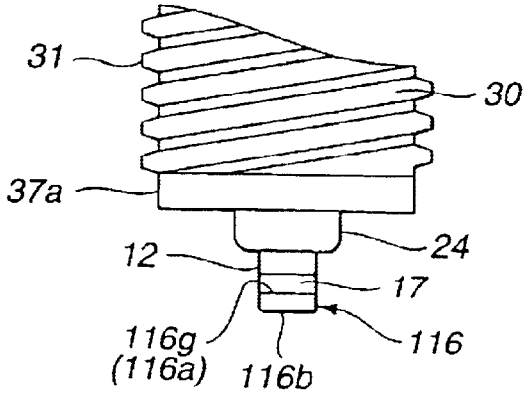
FIG. 2C is a view taken in the direction indicated by the arrow 2C in FIG. 2A.

Referring first to FIG. 1 wherein like parts and portions to those of FIGS. 10A to 10C and 11A to 11C are designated like reference characters, a spark plug for an internal combustion engine is generally indicated by 10 and includes an insulator 20 made of alumina. The insulator 20 has a corrugated rear end portion 22 and a front end portion 24. The insulator 20 has a concentric axial bore 26 extending along the center axis 18 thereof. Within the axial bore 26 and on the rear end side thereof is disposed a terminal 13 whose rear end protrudes from the rear end of the corrugated portion 22. Within the axial bore 26 and on the front end side thereof is disposed a center electrode 12, while disposing a glass resistance 11 between the center electrode 12 and the terminal 13. The center electrode 12 is made of an alloy containing nickel as a major constituent and is rod-shaped. A front end of the center electrode 12 protrudes from the insulator front end portion 24.

The front end portion 24 of the insulator 20 is disposed within the tubular metallic shell 30. The metallic shell 30 has on a front end side outer circumferential surface thereof an externally threaded potion 31 which is screwed into an internally threaded portion (not shown) of a cylinder head. To a front end face 37 of the metallic shell 30 is welded a ground electrode 116 which is nearly L-shaped. A tip end of the ground electrode 116 is adapted to face the center electrode 12 so as to form a spark gap 17 therebetween. On the rear side of the externally threaded portion 31, the metallic shell 30 has a seat portion 35 which is formed on the outer circumferential surface thereof. Onto a rear side end neck section 36 of the externally threaded portion 31 is fitted a gasket 40. On the rear end side of the metallic shell 30, the metallic shell 30 has a hexagonal portion 33 whose outer peripheral surface is shaped similarly to that of a hexagonal nut. To the hexagonal portion 33 is attached a plug wrench or the like tool for screwing the externally threaded portion 31 into the internally threaded portion of the cylinder head.

Figure 3A:
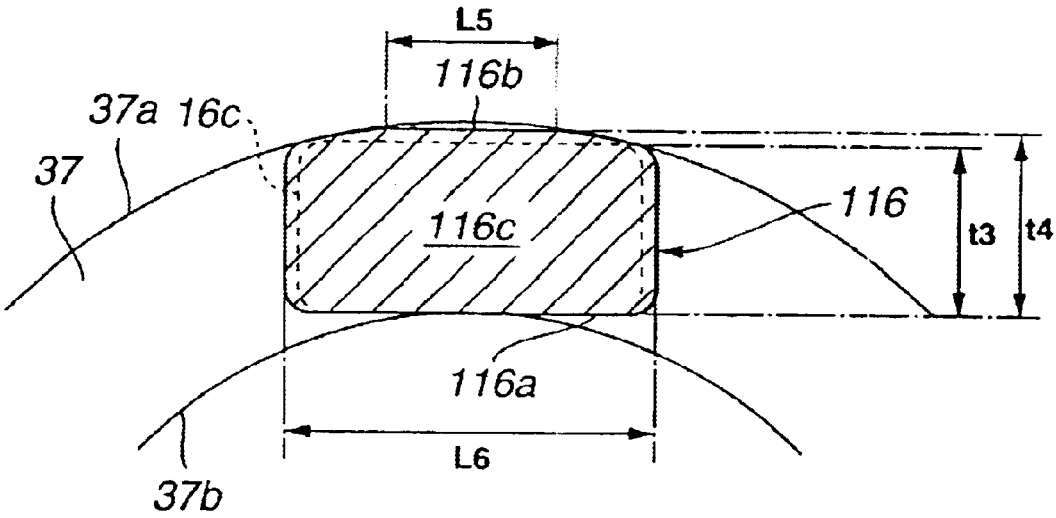
FIG. 3A is an enlarged view for illustrating a cross section of a welded portion of a ground electrode of the spark plug of FIG. 1.
Figure 3B:
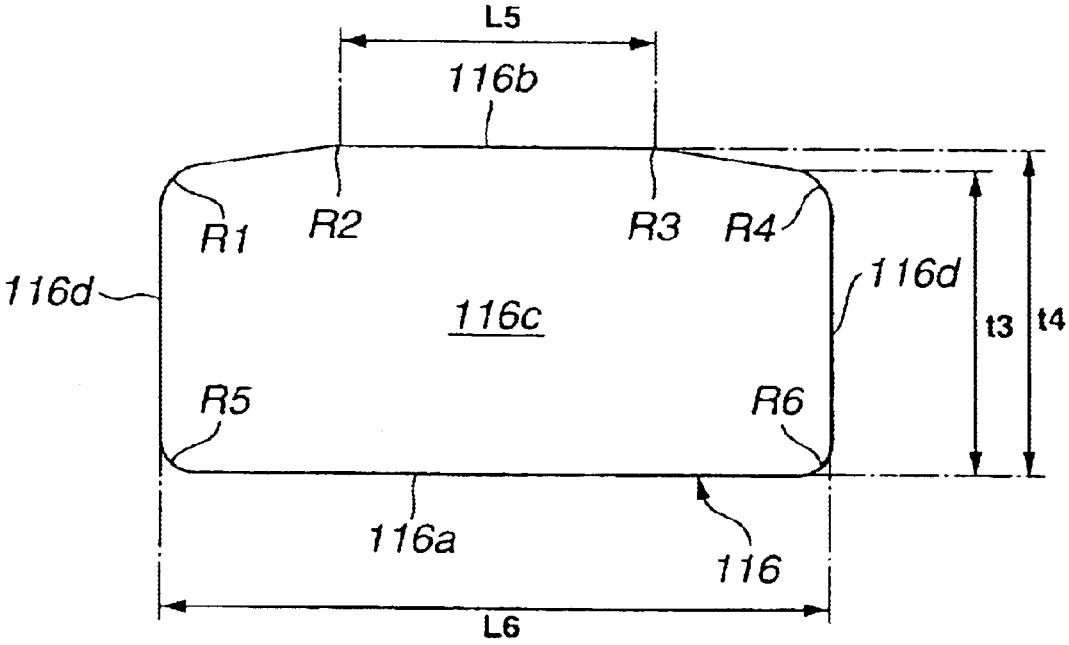
FIG. 3B is an enlarged view of the cross section of the welded portion of FIG. 3A.

Referring now to FIGS. 2A–2C and 3A–3B, the ground electrode 116 has a welded portion 116*c* which has such a cross section as shown in FIGS. 3A and 3B. Namely, the cross section of the welded portion 116C is polygonal and has a six corners R1 to R6. The cross section has a pair of opposite sides one of which corresponds to the side surface 116*b* of the ground electrode 116 and faces an outer circumferential periphery 37*a* of the front end face 37 of the metallic shell 30. The side corresponding to the side surface 116*b* ranges from the corner R1 to the corner R4. The side surface 116*b* is shaped so as to expand or protrude outward and contact or coincide at the corners R1 and R4 with the outer circumferential periphery 37*a* of the front end face 37 as shown in FIG. 3A. Namely, the side surface 116*b* has a central side surface section (i.e., a surface section between the corners R2 and R3) of the width L5 and parallely opposite to a central side surface section of the side surface 116*a* and a pair of oblique side surface sections (i.e., a surface section between the corners R1 and R2 and a surface section between the corners R3 and R4) at the opposite ends of the central side surface section. The side surface 116*a* of the ground electrode 116 includes a side surface portion 116*g* facing the front end face of the center electrode 12. The side surface 116*a* ranges from the corner R5 to the corner R6. Namely, the side surface 116*a* has the aforementioned central side surface section and a pair of rounded side surface sections at the opposite ends of the central side surface section.

The side surface 116*b* is thus shaped to have a narrower central side surface section as compared with that of the side surface 116*a*. Namely, the cross section of the ground electrode 116 is so shaped as to provide the side surface 116*b* at one of opposites sides which faces the outer circumferential periphery 37*a* of the front end face 37 of the metallic shell 30, with a narrower central side surface section than that of the side surface 116*a* at the other of the opposite sides. In other words, the side of the cross section corresponding to the side surface 116*b* is so shaped as to provide a trapezoidal part of the polygonal cross section.

The width of the side surface 116*d*, i.e., the minimum thickness t3 of the welded portion 116*c* is smaller than the maximum thickness t1 (i.e., 1.3 mm) of the corresponding ground electrode of the related art by 0.10 mm, i.e., t3 is 1.20 mm, and the maximum thickness t4 is larger than the minimum thickness t1 (i.e., 1.3 mm) of the corresponding ground electrode of the related art by 0.10 mm, i.e., t4 is 1.40 mm.

The maximum width L6 of the welded portion 116*c* is 2.90 mm and is larger than the maximum width L1 of the welded portion 16*c* of the ground electrode 16 of the related art by 0.20 mm. Further, the width L5 of the central side surface section of the side surface 116*b* is 1.40 mm. By this, it becomes possible to make the maximum width L6 and the maximum thickness t4 of the ground electrode 116 larger than those of the corresponding ground electrode 16 of the related art.

In this manner, the spark plug for the internal combustion engine according to the first embodiment can make the maximum width of the ground electrode 116 larger without causing the welded portion 116*c* of the ground electrode 116 to project from the front end face 37 of the metallic shell 30. In this connection, it is to be noted that the ground electrode 116 is nearly uniform in cross section.

Accordingly, the width of the side surface portion 116*g* facing the front end face of the center electrode 12 can be larger than that of the corresponding ground electrode 16 of the related art, thus making it possible to decrease the electrode consumption due to spark discharge and allow the ground electrode 116 to have an improved resistance to electrode consumption.

Further, since it is not necessary to make the inner diameter B of the metallic shell 30 smaller for thereby making the area of the front end face 37 larger, there never occurs a lateral or sideway jumping of spark which is caused by decrease of the clearance 24*a* (refer to FIG. 10B) between the inner circumferential surface of the metallic shell 30 and the outer circumferential surface of the insulator front end portion 24.

Further, since the maximum thickness t4 of the ground electrode 116 can be made larger than that of the ground electrode of the related art, the strength of the ground electrode 116 can be made larger.

Further, by making the width and the thickness of the ground electrode larger, the volume of the ground electrode 116 can be increased. By this, the heat of the ground electrode 116 can be conducted to the metallic shell 30 more easily. Namely, the ground electrode 116 can be cooled with an improved efficiency. Thus, the oxidation of the ground electrode 116 due to heating can be decreased and therefore deterioration of the durability of the ground electrode 116 due to oxidation thereof can be suppressed or prevented.

Figure 4:
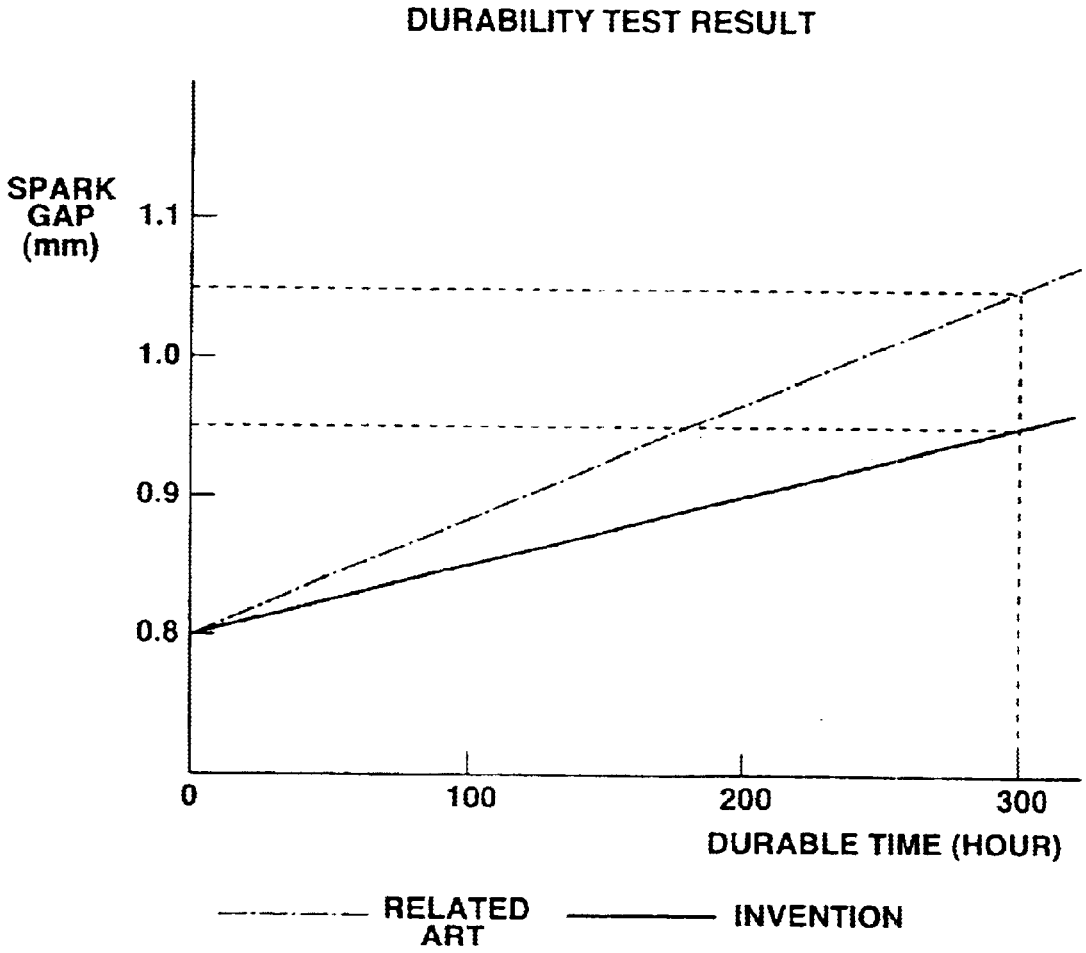
FIG. 4 is a graph showing the durability test result by the experiment 1.
Figure 5:
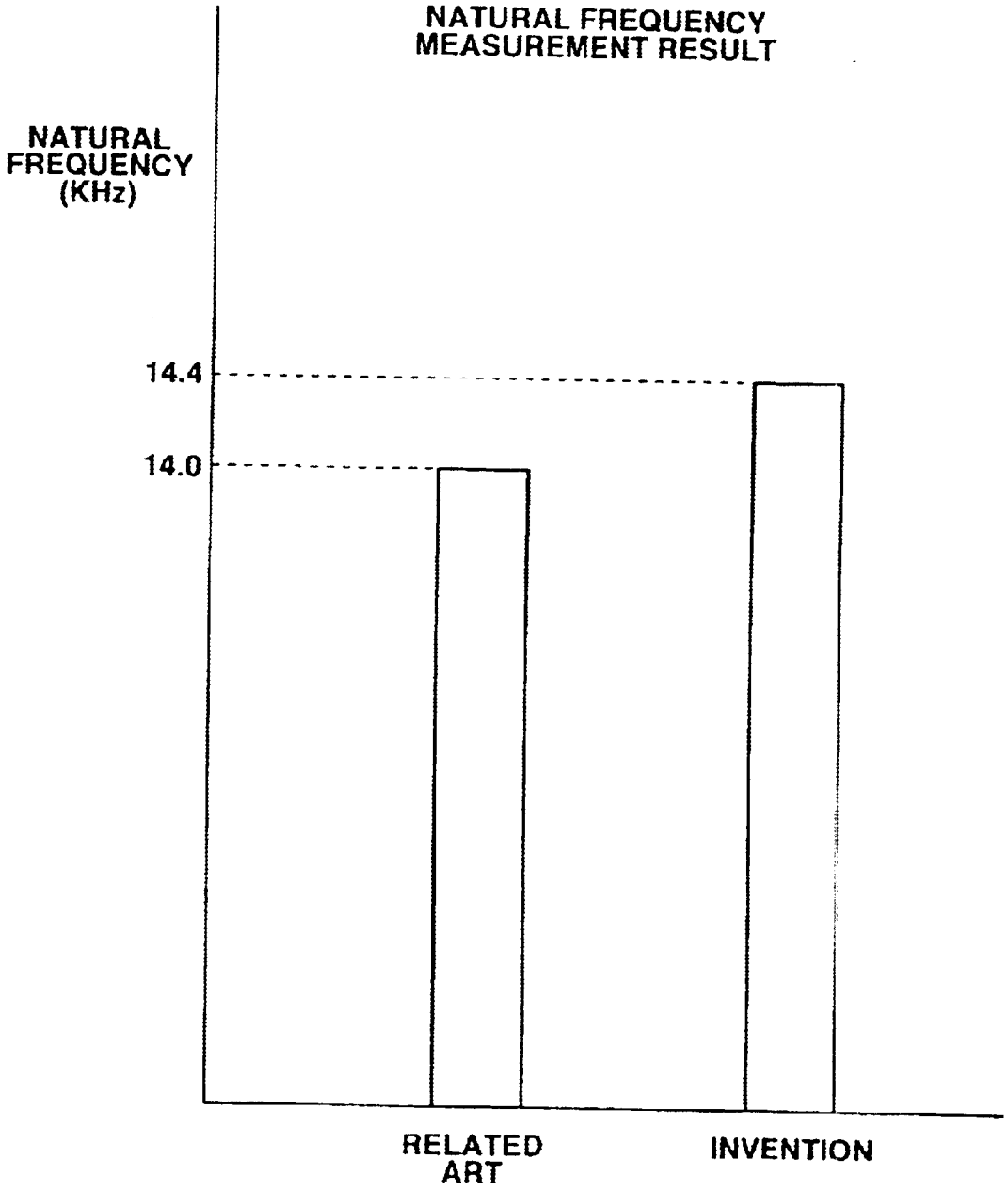
FIG. 5 is a graph showing a natural frequency measurement result by experiment 2.

Referring to FIGS. 4 to 6, the experiments conducted by the applicant will be described.

Experiment 1

Firstly, the durability test will be described with reference to FIG. 4.

Figure 11A:
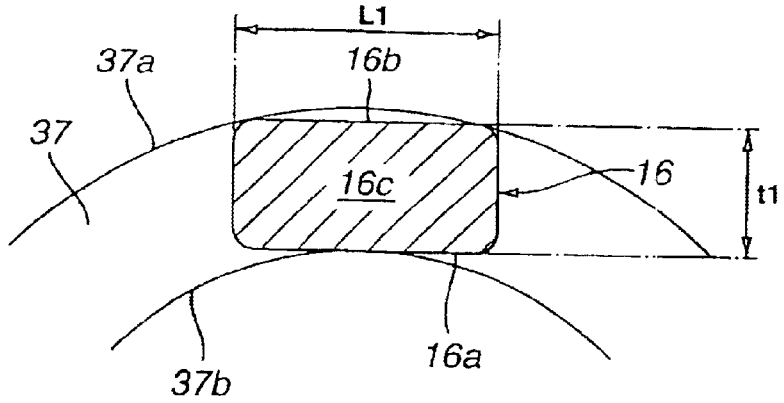
FIG.11A PRIOR ART
FIGS. 11A to 11C are views of various cross sectional shapes for a welded portion of a ground electrode of a spark plug according to a related art.
Figure 11B:
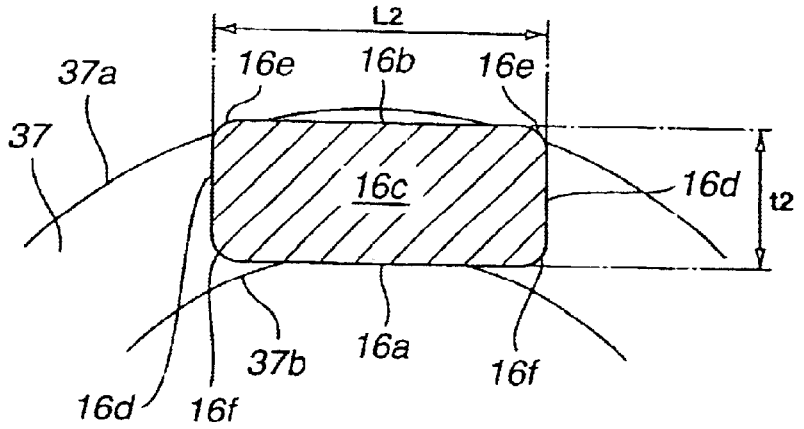
FIG.11B PRIOR ART

For the durability test, an example of the related art shown in FIG. 11A and an example of this invention shown in FIGS. 3A and 3B were used. In the meantime, both of the examples according to the related art and the present invention are 12 mm in the nominal diameter M and both have the same structure except for the ground electrodes thereof.

In the durability test, the spark plug was attached to a 1.6-L engine and the spark gap 17 was measured after 300 cycles of operation of the engine, each cycle being 60 minutes' operation and consisting of three minutes' idling, 10 minutes' operation at the output of 30 ps (horse power) and at the engine speed of 4,400 rpm, 15 minutes' operation at the output of 70 ps and at the engine speed of 6,400 rpm, 5 minutes' idling, 12 minutes' operation at the output of 19 ps and at the engine speed of 3,800 rpm, and 15 minutes' operation at the output of 50 ps and at the engine speed of 5,600 rpm. In the meantime, the horse power was converted to that attained during running of a vehicle on which the engine is installed.

The test result is shown in the graph of FIG. 4. As seen from the graph, the spark gap 17 of the example of the related art was about 1.05 mm. In contrast to this, the spark gap 17 of the example of this invention was about 0.95 mm. Thus, the spark gap of the example of this invention was 0.1 mm smaller than that of the example of the related art.

Thus, by this experiment, it was verified that the consumption of the ground electrode of the spark plug of this invention was smaller than that of the spark plug of the related art and therefore the ground electrode of the spark plug of this invention was more resistant to consumption due to spark discharge than that of the spark plug of the related art.

Experiment 2

The ground electrode 116 is nearly L-shaped as shown in FIG. 1 and is therefore caused to vibrate or swing about the base portion 116*f*. By this vibration, tensile stress and compressive stress are alternately applied to the base portion 116*f* of the ground electrode 116. Particularly, those stresses are applied much more to the inner side of the base portion 116*f*. Continued application of such stresses may possibly cause a crack in the base portion 116*f* of the ground electrode 116, and the progress of such a crack may possibly cause the ground electrode 116 to be broken.

Thus, measurement of the natural frequencies of the example of the related art shown in FIG. 11A and the example of this invention shown in FIGS. 3A and 3B was made. The result is shown in FIG. 5. In the meantime, both of the examples used were 12 mm in the nominal diameter M of the metallic shell 30 and had the same structure except for the ground electrodes.

As shown in FIG. 5, the natural frequency of the ground electrode 16 of the example of the related art was 14.0 KHz and the natural frequency of the ground electrode 116 of the example of this invention was 14.4 KHz. Therefore, the natural frequency of the example of this invention was 0.4 KHz higher than that of the example of the related art.

Thus, it was verified that the ground electrode of the spark plug of this invention was higher in the rigidity and smaller in the amplitude than that of the spark plug of the related art, and therefore more hard to cause a crack and higher in the durability.

Experiment 3

Then, the experiment was conducted on the sideway jumping of spark.

Figure 11C:
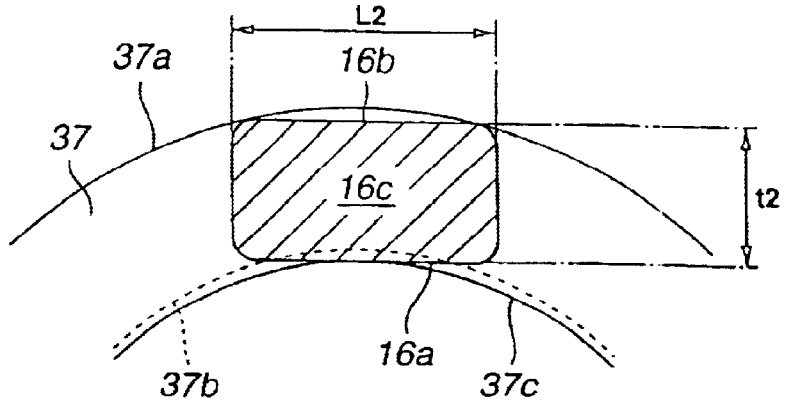
FIG.11C PRIOR ART

In the experiment, an example of the related art shown in FIG. 11C, an unmodified example shown in FIG. 11C and an example of this invention shown in FIG. 3A were used.

The test result is shown in FIG. 6. As shown in FIG. 6, on the basis of the applied voltage at the time sideway jumping of spark occurred in the example of the related art, the unmodified example caused a sideway jumping of spark at the applied voltage which was 1.3 kV smaller than that in the example of the related art. In contrast to this, the example of this invention caused a sideway jumping of spark at the same applied voltage with the example of the related art.

Namely, it was verified that the example of this invention does not cause the applied voltage at which a sideway jumping of spark occurs, to become lower than that in the example of the related art since in the example of this invention it was unnecessary to modify the clearance 24*a* between the inner circumferential surface of the metallic shell 30 and the outer circumferential surface of the insulator front end portion 24.

Figure 7A:
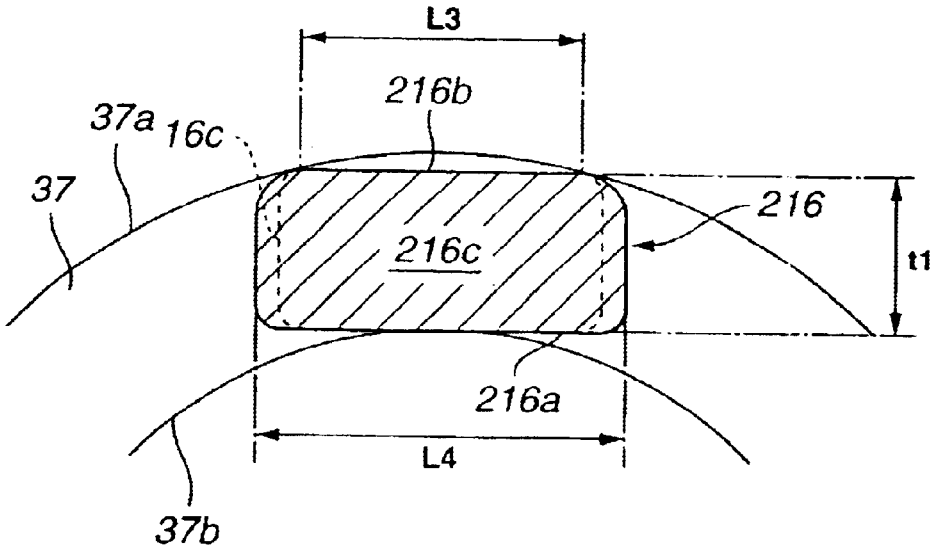
FIG. 7A is a view similar to FIG. 3A but shows a second embodiment of the present invention.
Figure 7B:
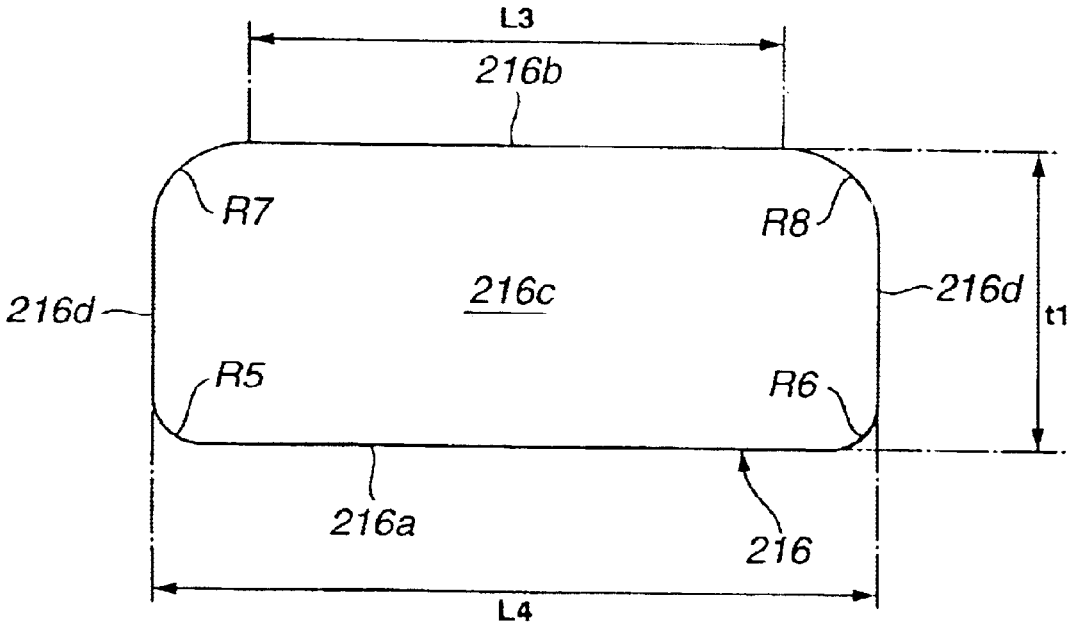
FIG. 7B is an enlarged view of the cross section of the welded portion of FIG. 7A.

Referring to FIGS. 7A and 7B in which like parts and portions to those of the first embodiment will be designated by reference characters, a spark plug according to a second embodiment will be described.

In this embodiment, the welded portion 216*c* of the ground electrode 216 has such a cross section that includes a first pair of corners R5 and R6 at the opposite ends of the side surface 216*a* and a second pair of corners R7 and R8 at the opposite ends of the side surface 216*b* opposite to the side surface 216*a*. Further, the second pair of corners R7 and R8 are rounded and defined by a radius larger than that for the first pair of corners R5 and R6. Namely, the side surface 216*b* has a central side surface section which is of the width L3 and which is narrower than that of the side surface 216*a*. By this, the maximum width L4 can be made larger without causing the corners R7 and R8 to project outward from the front end face 37.

The maximum width L4 of the ground electrode 216 is 3.10 mm and is therefore 0.40 mm larger than the maximum width L1 (i.e., 2.70 mm). Further, the maximum thickness t1 of the welded portion 216*c* is the same with that of the welded portion 16*c* of the related art shown in FIG. 11A, i.e., t1 is 1.30 mm.

In this manner, the spark plug according to the second embodiment is constructed so that the radius of the corners R7 and R8 at the opposite ends of the side surface 216*b* are larger than that of the corners R5 and R6 at the opposite ends of the side surface 216*a*, whereby it becomes possible to make the maximum width L4 larger without causing the welded portion 216*c* to project outward from the front end face 37 of the metallic shell 30.

This embodiment can produce substantially the same effect as the first embodiment.

Figure 9A:
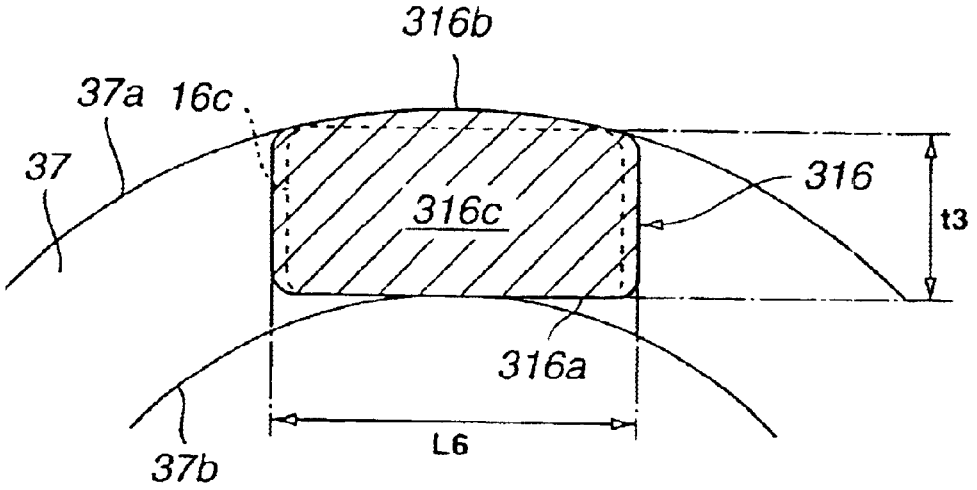
FIG. 9A is a view similar to FIG. 3A but shows a third embodiment of the present invention.
Figure 9B:
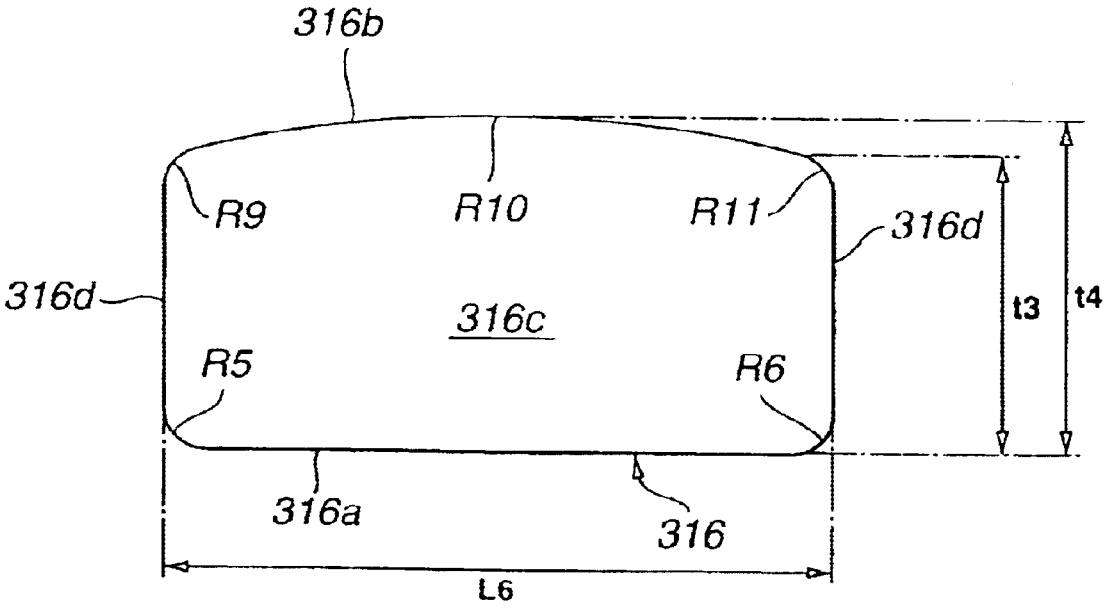
FIG. 9B is an enlarged view of the cross sectional shape of the welded portion of FIG. 9A.
Figure 10A:
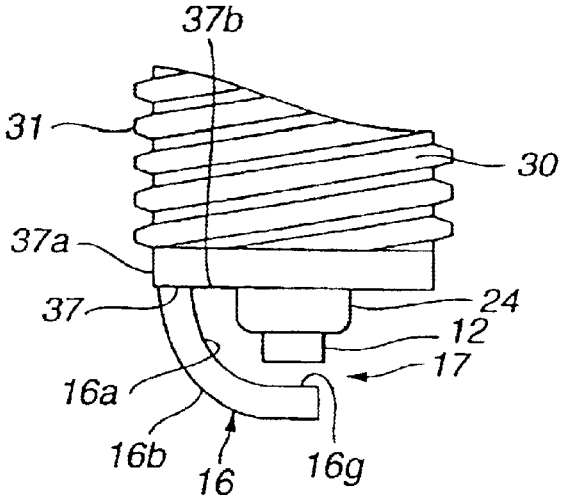
FIG.10A PRIOR ART
FIGS. 10A to 10C are views similar to FIGS. 2A to 2C but show a spark plug having a problem to be solved by the present invention.
Figure 10B:
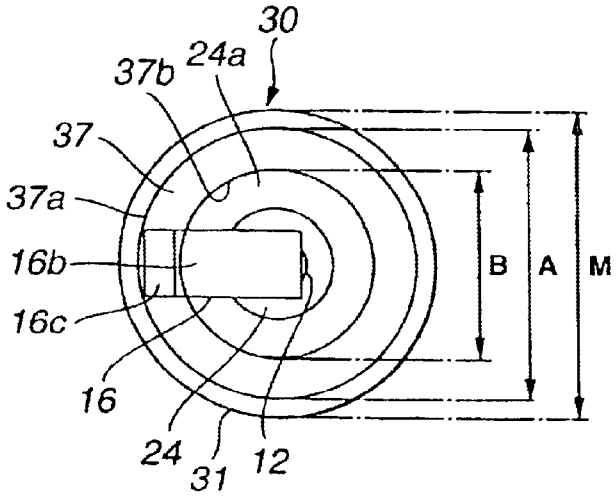
FIG.10B PRIOR ART
Figure 10C:
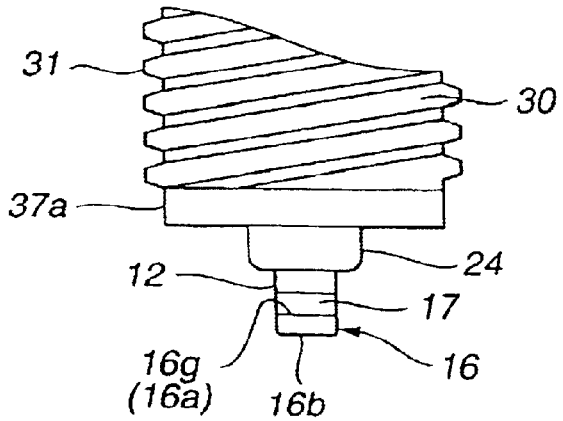
FIG.10C PRIOR ART

Referring to FIGS. 9A and 9B wherein like parts and portions to those of the first embodiment will be designated by like reference characters, a spark plug according to a third embodiment will be described.

In the this embodiment, the welded portion 316*c* has such a cross section that includes the corners R5 and R6 at the opposite ends of the side representing the side surface 316*a*, and a pair of corners R9 and R11 at the opposite ends of the side representing the side surface 316*b* opposite to the side surface 316*a*. The side representing the side surface 316*b* is formed into a circular arc R10. Namely, the side surface 316*b* is curved outward so as to coincide with the outer circumferential periphery 37*a* of the front end face 37. Further, the width of the side surface 316*d* of the welded portion 316*c*, i.e., the minimum thickness t3 of the welded portion 316*c* is 0.10 mm smaller than the maximum thickness t1 (i.e., 1.30 mm) of the prior art spark plug, i.e., t3 is 1.20 mm. The maximum thickness t4 is 0.10 mm thicker than the maximum thickness t1 of the spark plug of the related art, i.e., t4 is 1.40 mm.

By this, it becomes possible to make the maximum width L6 and the maximum thickness t4 of the ground electrode 316 larger than those of the spark plug of the related art without causing the corners R9 and R11 to project from the front end face 37 of the metallic shell 30. The maximum width L6 of the ground electrode 316 is 2.90 mm and is 0.20 mm larger than the maximum width L1 (i.e., 2.70 mm) of the ground electrode of the related art.

This embodiment can produce substantially the same effect as the first embodiment.

Figure 8A:
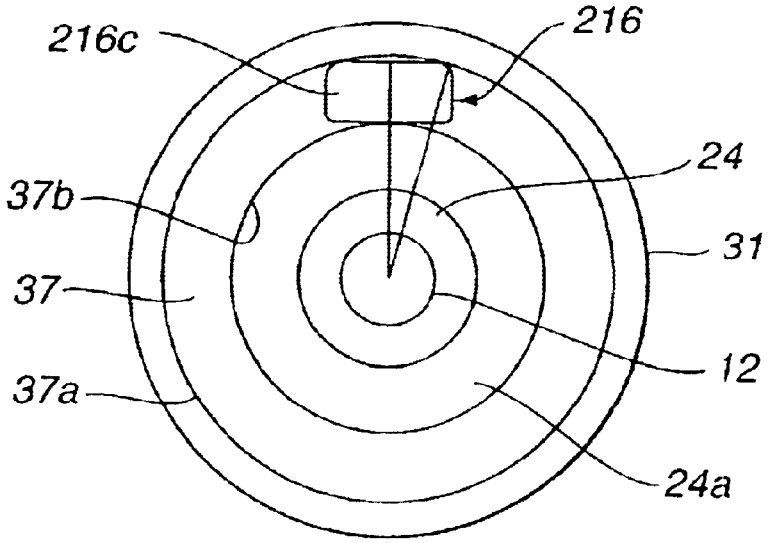
FIG. 8A is a schematic view for illustrating the position of the welded portion of FIG. 7A.
Figure 8B:
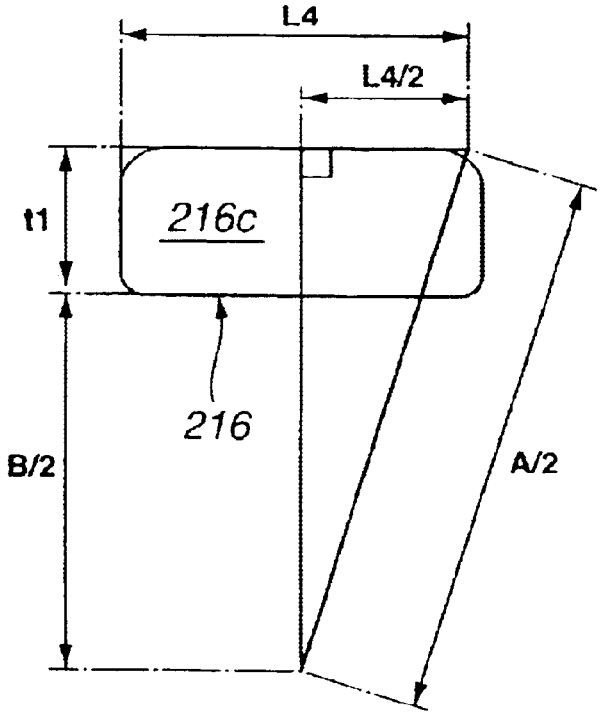
FIG. 8B is an illustration for obtaining an expression of a relation between the thickness t1 and the width L4 of the welded portion of FIG. 7A.

Referring to FIGS. 8A and 8B, by taking the spark plug of the second embodiment, an expression representative of the relation between the maximum thickness t1 and the maximum width L4 of the ground electrode 216 is obtained.

From FIG. 8B, the following expression (1) can be derived.

$$(L4/2)^2+\{t\mathbf{1}+(B/2)\}^2=(A/2)^2 \quad (1)$$

Accordingly, from the expression (1), the following expression (2) for obtaining the maximum width L4 is derived.

$$L4=2[(A/2)^2-\{(B/2)+t\mathbf{1}\}^2]^{1/2} \quad (2)$$

Further, by the calculation made by the applicant, it was found that the width and the thickness of the ground electrode 16 could be increased without causing the welded portion 14 to project from the front end face 37 by setting the maximum thickness t1 so as to satisfy the following expression (3), by setting the maximum width L4 so as to satisfy the following expression (4), and by setting the outer diameter A so as to satisfy the following expression (5).

$$(A-B)/3<t\mathbf{1}\leqq(A-B)/2 \quad (3)$$

$$2[(A/2)^2-\{(B/2)+t\mathbf{1}\}^2]^{1/2}<L4<3[(A/2)^2-\{(B/2)+t\mathbf{1}\}^2]^{1/2} \quad (4)$$

$$(M-1.7\ P)\leqq A<(M-1.5\ P) \quad (5)$$

wherein M is the nominal diameter of the externally threaded portion 31 of the metallic shell 30 and P is the pitch of externally threaded portion 31.

In the meantime, the spark plug of the kind of 8.00 mm in the nominal diameter M of the externally threaded portion is sized, for example, such that the outer diameter A is 6.50 mm, the inner diameter B is 4.60 mm, and the pitch P is 1.00 mm. The spark plug of the kind of 10.00 mm in the nominal diameter M of the externally threaded portion is sized, for example, such that the outer diameter A is 8.45 mm, the inner diameter B is 6.00 mm, and the pitch P is 1.00 mm. The spark plug of the kind of 12.00 mm in the nominal diameter M of the externally threaded portion is sized, for example, such that the outer diameter A is 10.10 mm, the inner diameter B is 7.20 mm, and the pitch P is 1.25 mm. The spark plug of the kind of 14.00 mm in the nominal diameter M of the externally threaded portion is sized, for example, such that the outer diameter A is 12.10 mm, the inner diameter B is 8.40 mm, and the pitch P is 1.25 mm.

Although the invention has been described above by reference to certain embodiments of the invention, the invention is not limited to the elements described above. Modifications and variations of the embodiments described above will occur to those skilled in the art, in light of the above teachings. For example, the structure of the spark plug having been described and shown is not for the purpose of limitation but the invention can be applied to various spark plugs having various structures.

The scope of the invention is defined with reference to the following claims.

What is claimed is:

1. A spark plug for an internal combustion engine comprising:

a metallic shell having an externally threaded portion;

an insulator disposed within the metallic shell and having an axial bore;

a center electrode disposed within the axial bore of the insulator; and a ground electrode connected to a front end face of the metallic shell and having an end opposite to a front end face of the center electrode;

wherein a cross section of the ground electrode is so shaped as to provide a side surface at one of opposite sides which faces an outer circumferential periphery of the front end face of the metallic shell, with a narrower central side surface section than that of a side surface at the other of the opposite sides, the central side surface section at one of the opposite sides being parallel and opposite to the central side surface section at the other of the opposite sides, and wherein the cross section of the ground electrode is so shaped as to satisfy $(L/2)^2+\{t+(B/2)\}^2=(A/2)^2$, $L=2[(A/2)^2-\{(B/2)+t\}^2]^{1/2}$, $(A-B)/3<t\leqq(A-B)/2$, $2[(A/2)^2-\{(B/2)+t\}^2]^{1/2}<L<3[(A/2)^2-\{(B/2)+t\}^2]^{1/2}$, $(M-1.7\ P)\leqq A<(M-1.5\ P)$, where M is a nominal diameter of the externally threaded portion, P is a pitch of the externally threaded portion, A is an outer diameter of the front end face of the metallic shell, B is an inner diameter of the front end face of the metallic shell, L is the width of the surface portion of the inner side surface of the ground electrode, and t is a maximum thickness of the ground electrode.

2. A spark plug according to claim 1, wherein one of the opposite sides which faces the outer circimiferential periphery of the front end face of the metallic shell comprises at least one corner projecting outward.

3. A spark plug according to claim 1, wherein the side surface at one of the opposite sides which faces the outer circumferential periphery of the front end face of the metallic shell further comprises a pair of oblique side surface sections at the opposite ends of the central side surface section.

4. A spark plug according to claim 3, wherein the side surface at the other of the opposite sides further comprises a pair of rounded side surface sections at the opposite ends of the main side surface section.

5. A spark plug according to claim 1, where in the cross section of the ground electrode is polygonal.

6. A spark plug according to claim 5, wherein one of the opposite sides which faces the outer circumferential periphery of the front end face of the metallic shell is bent so as to define a trapezoidal part of the polygonal cross section.

7. A spark plug according to claim 6, wherein the cross section of the ground electrode has six rounded corners, four of which are positioned at or adjacent the outer circumferential periphery of the front end face of the metallic shell.

8. A spark plug according to claim 1, wherein the cross section is rectangular and has a first pair of corners located at or adjacent the outer circumferential periphery of the front end face of the metallic shell and a second pair of corners located at or adjacent an inner circumferential periphery of the front end face of the metallic shell, the first pair of corners being rounded with a larger radius than that with which the second pair of corners are rounded.

* * * * *